United States Patent [19]

Sneed et al.

[11] Patent Number: 4,517,714

[45] Date of Patent: May 21, 1985

[54] NONWOVEN FABRIC BARRIER LAYER

[75] Inventors: Scott W. Sneed; Bill R. Schwam, both of Memphis; Paul E. Gregory, Jr., Germantown, all of Tenn.

[73] Assignee: The Procter & Gamble Company, Cincinnati, Ohio

[21] Appl. No.: 401,169

[22] Filed: Jul. 23, 1982

[51] Int. Cl.[3] ..... D04H 3/10

[52] U.S. Cl. ..... 28/103; 28/117; 264/DIG. 47; 428/198

[58] Field of Search ..... 28/103, 117, 134; 264/DIG. 47, 286; 425/66; 428/198, 903

[56] References Cited

U.S. PATENT DOCUMENTS

| | | | |
|---|---|---|---|
| 3,233,029 | 2/1966 | Rasmussen | 264/288 |
| 3,542,634 | 11/1970 | Such et al. | 428/198 X |
| 3,765,974 | 10/1973 | Petersik et al. | 428/198 X |
| 3,852,007 | 12/1974 | Levers et al. | 425/66 |
| 3,961,119 | 6/1976 | Thomas | 428/198 X |
| 4,048,364 | 9/1977 | Harding et al. | 428/113 |
| 4,144,008 | 3/1979 | Schwarz | 425/66 |
| 4,153,664 | 5/1979 | Sabee | 264/289 |
| 4,196,245 | 4/1980 | Kitson et al. | 428/198 |
| 4,223,059 | 9/1980 | Schwarz | 428/198 |

OTHER PUBLICATIONS

Industrial & Engineering Chemistry, vol. 48, No. 8, 1954, pp. 1342–1346, Wente, V. A. "Superfine Thermoplastic Fibers".

*Primary Examiner*—Werner H. Schroeder
*Assistant Examiner*—Andrew M. Falik
*Attorney, Agent, or Firm*—Fredrick H. Braun; Milton B. Graff, IV; Richard C. Witte

[57] ABSTRACT

A process for making a nonwoven fabric barrier layer that comprises simultaneously ring-rolling to a desired basis weight at least two adjacent plies of hydrophobic microfine fiber webs. The adjacent plies prior to ring-rolling have a cumulative basis weight of from about 1.1 to about 4 times the desired basis weight.

8 Claims, 3 Drawing Figures

NONWOVEN FABRIC BARRIER LAYER

TECHNICAL FIELD

The invention relates to a nonwoven fabric barrier layer which is characterized by unique relationships between air permeability and resistance to liquid strikethrough, and a process for manufacturing such a barrier layer.

BACKGROUND ART

The nonwoven fabric barrier layer of the present invention has many applications and, in fact, may be used wherever its unique liquid strikethrough resistance/air porosity relationships would be advantageous. For example, the barrier layer could be used in the manufacture of clothing, especially that made from nonwoven fabrics, where a barrier to liquid strikethrough is desired, e.g. laboratory coats, artists' smocks, hospital scrub clothes, rainwear, or the like. A high air porosity is desired for fabrics used for such clothing to provide greater comfort to the wearer. The advantages of the barrier layer of the present invention are best demonstrated where the barrier layer is a relatively separate layer of such clothing with minimal adhesive adherence to other fabric layers.

As used herein, the phrase "liquid strikethrough" refers to the passage of liquid from one surface of the barrier layer, through the barrier layer, to the other surface of the barrier layer.

U.S. Pat. No. 4,196,245 issued to Richard P. Kitson, Richard L. Gilbert, Jr., and Joseph Israel on Apr. 1, 1980, discloses a composite nonwoven fabric with superior liquid strikethrough resistance/air porosity relationship. It discloses a composite nonwoven fabric having an air permeability in excess of 100 $mm^3$/sec-$mm^2$ at 12.7 mm $H_2O$ differential pressure, and a liquid strikethrough resistance well in excess of 250 mm of $H_2O$. This liquid strikethrough resistance/air porosity relationship is achieved by having at least two adjacent hydrophobic plies of microfine fibers of a fiber diameter of about 10 microns or less incorportated in the composite nonwoven fabric having at least one other ply.

The present invention is directed to a barrier layer which provides superior liquid strikethrough resistance while maintaining high air porosity. The barrier layer is produced by the process of ring-rolling at least two adjacent hydrophobic, thermoplastic plies of microfine fibers. Ring-rolling is achieved by feeding the adjacent plies between an interdigitating set of grooved rolls.

Prior art workers have used ring-rolling to stretch materials. The stretching of thermoplastic materials by ring-rolling is generally done to achieve molecular orientation of the thermoplastic material in the direction of stretch, thus increasing the strength of the thermoplastic material in that direction. The ring-rolling of thermoplastic films is disclosed in U.S. Pat. No. 3,233,029 issued to Ole-Bendt Rasmussin on Feb. 1, 1966, and in U.S. Pat. No. 4,144,008 issued to Eckhard C. A. Schwarz on Mar. 13, 1979.

The production of microfine fiber, thermoplastic webs which may then be strengthened by stretching in one direction is disclosed in U.S. Pat. No. 4,048,364 issued to John W. Harding & James P. Keller on Sept. 13, 1977. U.S. Pat. No. 4,223,059 issued to Eckhard C. A. Schwarz on Sept. 16, 1980, discloses the ring-rolling of such microfine thermoplastic fiber webs in order to stretch and strengthen the webs. Ring-rolling of "web lamina" consisting of two microfine thermoplastic fiber webs separated by a layer of absorbent fibers to produce a high loft fabric is also disclosed by the Schwarz '059 patent.

SUMMARY OF THE INVENTION

It is an object of the present invention to provide a novel process for producing a barrier layer having high liquid strikethrough resistance.

It is a further object of this invention to provide such a process for producing a barrier layer having high liquid strikethrough resistance while maintaining high air porosity.

It is also an object of this invention to provide a process for producing a barrier layer which may consist only of plies of hydrophobic microfine fibers.

These and other objects will become apparent from the detailed description which follows.

The present invention concerns a process for making a nonwoven fabric barrier layer of desired basis weight by simultaneously ring-rolling to the desired basis weight at least two adjacent plies of hydrophobic microfine fiber webs. The adjacent plies have an initial cumulative basis weight of from about 1.1 to about 4 times the desired basis weight.

DETAILED DESCRIPTION OF THE INVENTION

The present invention involves a nonwoven fabric barrier layer which is produced by ring-rolling at least two adjacent plies of microfine fiber webs.

Figure 1:
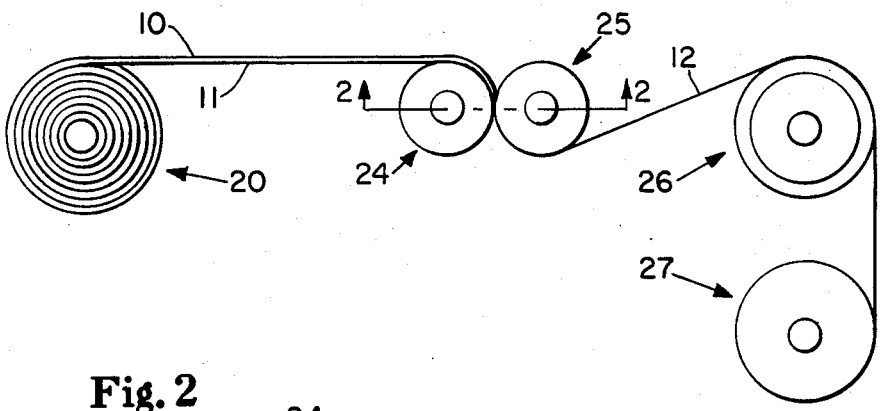
FIG. 1 is a schematic view of a preferred process for making the barrier layer of the present invention.

A preferred process for producing the barrier layer of the present invention is illustrated schematically in FIG. 1.

Webs 10 and 11 are preferably nonwoven webs of microfine hydrophobic fibers having a fiber diameter of up to about 10 microns, and preferably up to about 4 microns. For example, the webs may be melt-blown webs of the type taught in the article entitled "Superfine Thermoplastic Fibers" by Van A. Wente, appearing in *Industrial Engineering Chemistry,* August, 1956, Vol. 48, No. 8 (pages 1342–1346). While melt-blown material may be nylon, polyester, or any polymer or polymer blend capable of being melt-blown, a melt-blown polypropylene web is preferred. A melt-blown web could comprise two or more zones of different melt-blown polymers. Melt-blown webs having a basis weight of up to about 30 g/$m^2$ or more can be used in the present invention, but lower weight webs are generally preferred in order to minimize the cost of the barrier layer produced thereform. Current technology provides for the production of melt-blown webs with a minimum basis weight of about 3 g/$m^2$, but readily available commercial melt-blown webs generally have a basis weight of 10 g/$m^2$ or more. The preferred basis weight for webs 10 and 11 is from about 10 g/$m^2$ to about 30 g/$m^2$; most preferably from about 10 g/$m^2$ to about 20 g/$m^2$. The densities of melt-blown webs 10 and 11 are preferably up to about 0.15 g/cc and most preferably up to about 0.1 g/cc. Webs 10 and 11 may or may not be identical.

Figure 2:
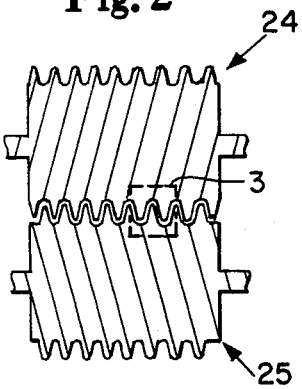
FIG. 2 is a sectional view of the interdigitating grooved rolls of FIG. 1 taken along lines 2—2.

Melt blown webs 10 and 11 have preferably been rolled up together as plies with adjacent surfaces on feed roll 20 in a separate step not shown. They are unrolled from feed roll 20 retaining their adjacent relationship and passed into the nip of interdigitating grooved rolls 24 and 25. Grooved rolls 24 and 25 have grooves perpendicular to the axis of the rolls (parallel to the machine direction) as shown in FIG. 2 which is a sectional view of grooved rolls 24 and 25 taken along line 2—2 of FIG. 1.

It has been found that webs 10 and 11 will be stretched more uniformly with less tendency to tear the webs when interdigitating grooved rolls 24 and 25 are heated. The rolls are preferably heated such that their surface temperatures are within the range of about 160° F. to 220° F.; more preferably within the range of 180° F. to 200° F. FIG. 1 shows a preferred arrangement of interdigitating grooved rolls 24 and 25 being located with their centers in a horizontal plane and webs 10 and 11 contacting the surface of roll 24 for about one-fourth of a revolution before entering the nip between rolls 24 and 25; this provides an opportunity for webs 10 and 11 to be heated prior to entering the nip. However, interdigitating grooved rolls 24 and 25 could be positioned with their centers in a vertical plane or at any other angle and webs 10 and 11 could be fed directly into the nip of the rolls. Preheating of webs 10 and 11 if found to be necessary in order to avoid tearing of the webs, could be accomplished in any conventional manner.

The web plies 10 and 11 are stretched and enmeshed while passing between the interdigitating grooved rolls 24 and 25 and are thus lightly bonded together producing barrier layer 12. Where barrier layer 12 has been stretched in the cross-machine direction by the grooved rolls 24 and 25 of FIGS. 1 and 2, a device such as a curved Mount Hope roll 26 or tenter clamps is needed to extend the barrier layer to its fullest width. The extended and smoothed barrier layer 12 is then rolled up on a takeup roll 27.

The amount of lateral stretch imparted to web plies 10 and 11 by the grooved rolls 24 and 25 will depend on the shape and depth of the grooves of the rolls, and on the gap spacing between the rolls.

U.S. Pat. No. 4,223,059, issued to Eckhard C. A. Schwarz on Sept. 16, 1980 discloses interdigitating rolls having grooves of generally sine-wave shape cross-section which may be used for the present invention. U.S. Pat. No. 4,153,664 issued to Rinehardt N. Sabee on May 8, 1979, discloses the stretching of polymeric webs by ring-rolling with rolls having grooves with a variety of shapes. The shape of the grooves of the rolls will generally determine whether the web is stretched uniformly or at incremental, spaced portions of the web. Incremental stretching of the web is more likely to cause some local tearing of fibers which would damage the liquid strikethrough resistance of the barrier layer and, therefore, is not preferred for the present invention.

Figure 3:
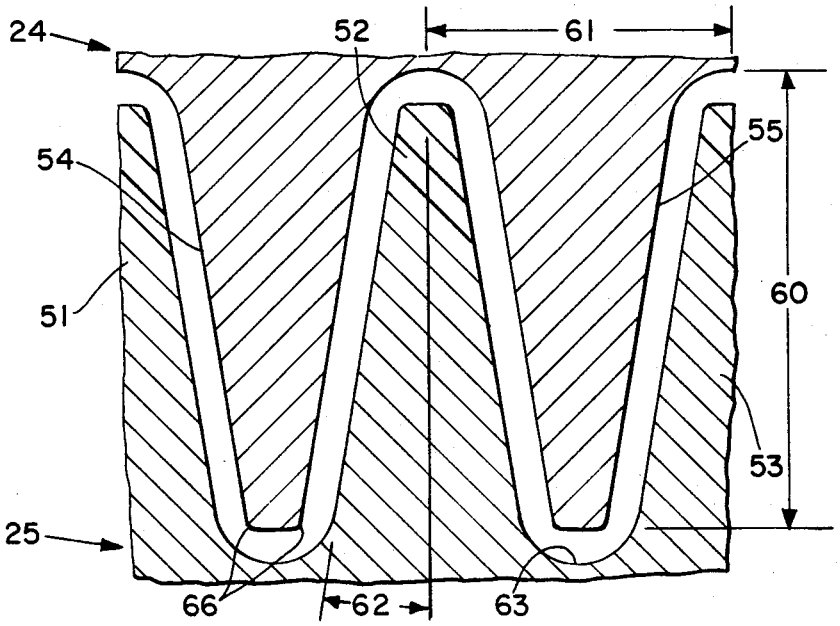
FIG. 3 is an enlarged view of area 3 from FIG. 2 showing several interdigitating teeth of the grooved rolls.

A preferred groove pattern for interdigitating rolls 24 and 25 is shown in FIG. 3 which is an enlarged view of area 3 of FIG. 2. FIG. 3 shows a partial cutaway view of interdigitating rolls 24 and 25. Teeth 54 and 55 of grooved roll 24 intermesh with teeth 51, 52 and 53 of grooved roll 25. The length 60 of the teeth is 3.81 mm., and the distance 61 between the centerlines of adjacent teeth on each roll is 2.54 mm. The teeth have generally straight sides which are at an angle 62 from a plane perpendicular to the axis of rolls 24 and 25 of 9° 17′. The land at the base of the teeth has a radius 63 of 0.51 mm. Sharp corners 66 at the ends of the teeth are removed.

It is preferred that the interdigitating grooves of rolls 24 and 25 be perpendicular to the axis of the rolls. In this way, the maximum number of grooves of a given size will engage webs 10 and 11 at the same time and impart stretch to the webs. By having the maximum number of teeth engage the webs at a given time, a more uniform stretching of the webs is achieved so that local tearing of the fibers is minimized. The stretched barrier layer 12 can be easily smoothed in the cross-machine direction.

A reproducible gap setting between grooved rolls 24 and 25 can be achieved by having the bearings of one of the grooved rolls, e.g. 24, stationary while those of the other grooved roll 25 can be moved in the horizontal direction. Groove roll 25 is moved toward roll 24 until its teeth are intermeshed with those of grooved roll 24 and it will move no further. The bearings of grooved roll 25 are then moved away from grooved roll 24 a measured distance, the gap setting. The preferred gap settings for practicing the present invention are from about 0.76 mm. to about 1.65 mm. With grooved rolls 24 and 25 having a tooth configuration as shown in FIG. 3 and described above, the maximum width of barrier layer 12 which can be achieved for a single pass is about $2\frac{1}{2}$ to 3 times the width of starting webs 10 and 11. By increasing the gap between grooved rolls 24 and 25, the amount of lateral stretch imparted to webs 10 and 11 is decreased. Therefore, the width of barrier layer 12 compared to the width of starting webs 10 and 11 can be varied for a single pass between grooved rolls 24 and 25 from a maximum increase of $2\frac{1}{2}$ to 3 times to no increase by the appropriate gap setting.

If it is desired to stretch webs 10 and 11 more than can be achieved by a single pass between the grooved rolls, multiple passes between grooved rolls 24 and 25 can be used.

Basis weight is generally an important property desired to be controlled for barrier layer 12. For cost reasons, the lightest barrier layer that will provide sufficient strikethrough resistance is desired. A lighter barrier layer will also generally provide other benefits such as higher air permeability and more cloth-like properties. The desired basis weight can be obtained by controlling the amount of stretch imparted to webs 10 and 11 by grooved rolls 24 and 25 as described above, and by the selection of the basis weights of the starting webs 10 and 11. For the present invention, starting webs 10 and 11 have a cumulative basis weight in the range of about 1.1 to 4 times the desired basis weight, preferably in the range of about 1.5 to 3 times the desired basis weight, most preferably about 2 times the desired basis weight. Correspondingly, the desired width of barrier layer 12 can be achieved by selecting a proper combination of stretch imparted by the grooved rolls 24 and 25 and initial width of starting webs 10 and 11. For the present invention, the initial width of starting webs 10 and 11 before passing between grooved rolls 24 and 25 is within the range of about 0.9 to about 0.25 times the desired width, preferably within the range of about 0.7 to about 0.3 times the desired width, most preferably about 0.5 times the desired width.

TEST PROCEDURES

The test procedures used to determine the unique properties of the barrier layers of the present invention and to provide the test results in the examples below are as follows:

Air Porosity Test

The test for air porosity of the barrier layers conforms to the ASTM Test Method D-737, with the exception that the material to be tested is conditioned at 23°±1° C. and 50±2% relative humidity for a minimum of 12 hours prior to testing. The air porosity is reported as cubic millimeters per second per square millimeter at 12.7 mm $H_2O$ differential pressure. A high volume is desired.

Liquid Column Strikethrough Resistance Test

The liquid strikethrough resistance test is a method for determining the water pressure in millimeters of water at which water penetrates a repellent barrier layer at a specified fill rate and with the water and barrier layer at a specified temperature.

The strikethrough tester comprises a vertically mounted clear plastic tube with an inside diameter of 50.8±1.6 mm having a flange on the bottom of the tube with rubber gaskets to hold the samples. Each sample consists of at least five individual test specimens cut to 90 mm by 90 mm.

Each test specimen is appropriately affixed to the bottom of the tube. Water is introduced into the tube at a filling rate of 6.7 cc per second giving a rate increase of water pressure of 3.3 mm of water per second. Both the water and the barrier layer are conditioned to 23°±1° C. When the first drop of water penetrates the sample specimen, the column height is read for that specimen in millimeters of water. The liquid column strikethrough resistance value for each sample is an average of the values of the 5 specimens for that sample. A high value is desired.

EXAMPLES 1, 2, 3, and 4

Examples 1, 2, 3, and 4 are all from samples of a commercial melt-blown polypropylene web, POLYWEB®, obtained from Riegel Products Corp., Milford, N.J., having a nominal basis weight of 15 g/m². Examples 1 and 2 are different samples of such web. Examples 3 and 4 were produced from samples of the same two rolls of webs as Examples 1 and 2, respectively. Two adjacent web plies of a starting material were run through the nip of a pair of grooved rolls having grooves as shown in FIG. 3 and described hereinabove, and a gap setting of 1.42 mm for Example 3, and 1.02 mm. for Example 4. The interdigitating grooved rolls were about 8" in diameter and were positioned with their centers in a horizontal plane as shown for rolls 24 and 25 in FIG. 1. The surface temperature of the rolls was between 175°–195° F. for Example 3, and was about 180° F. for Example 4. The two web plies were fed across the top of grooved roll 24 and into the nip between the rolls at a speed of between 22 and 31 feet per minute for Example 3, and at about 12 feet per minute for Example 4. For both Examples 3 and 4, the two web plies were stretched in the lateral direction such that the final width of the ring-rolled barrier layer was approximately two times the width of the original web plies. Table 1 below lists the basis weight, strikethrough resistance, and air porosity of Examples 1 through 4.

TABLE 1

| Example No. | Basis Weight (g/m²) | Liquid Column Strikethrough (mm $H_2O$) | Air Porosity at 12.7 mm $H_2O$ (mm³/sec-mm²) |
|---|---|---|---|
| 1 | 14.3 | 270 | 680 |
| 2 | 16.4 | 330 | 590 |
| 3 | 16.8 | 480 | 470 |
| 4 | * | 460 | 730 |

*A basis weight for Example 4 of 23.5 is believed to be in error due to inadequate flattening of the sample in making the basis weight measurement. Since the width of the ring-rolled barrier layer in Example 4 was about double the width of the starting webs, the basis weight was necessarily about the same as that of Examples 1–3.

Ring-rolling of the two plies of starting webs to produce Examples 3 and 4 resulted in barrier layers having about the same basis weight as one of the original web plies. Air porosity of the ring-rolled barrier layers is about the same or slightly less than that of the original web, but there is a substantial increase in the liquid strikethrough resistance of the ring-rolled barrier layers.

EXAMPLES 5, 6, 7, AND 8

Example 5 is a single ply of POLYWEB® of nominal basis weight of 30 g/m². Example 6 is two plies with adjacent surfaces of POLYWEB® each of nominal basis weight of 15 g/m². Example 7 was produced by separately ring-rolling two samples of the POLYWEB® of Example 5 through the same grooved rolls used to produce Examples 3 and 4. The webs were fed into the roll nip at about 15 ft./min. with a gap setting between the rolls of 0.89 mm and the surface temperature of the rolls at about 210° F. Two separate ring-rolled webs were produced each having a basis weight of approximately 15 g/m²; these separate webs were placed with their surfaces adjacent to make Example 7. Example 8 was produced by ring-rolling together two plies with adjacent surfaces of the POLYWEB® of Example 5 through the same grooved rolls at the same speed and roll surface temperature as used to produce Example 7; the gap setting between the rolls was 1.14 mm. A ring-rolled barrier layer of approximately 30 g/m² basis weight was thus produced. Table 2 below lists the basis weight, liquid strikethrough resistance, and air porosity of Examples 5–8.

TABLE 2

| Example No. | Basis Weight (g/m²) | Liquid Column Strikethrough (mm $H_2$) | Air Porosity at 12.7 mm $H_2O$ (mm³/sec-mm²) |
|---|---|---|---|
| 5 | 33.0 | 470 | 340 |
| 6 | 31.8 | 480 | 340 |
| 7 | 33.0 | 390 | 390 |
| 8 | 33.5 | 600 | 300 |

The liquid strikethrough resistance of the single 30 g/m² web and the combination of two 15 g/m² webs are nearly equal as shown by Examples 5 and 6. Example 7 shows that ring-rolling two melt blown webs separately and placing them with surfaces adjacent results in a structure with reduced liquid strikethrough resistance. Example 8 shows an increase in liquid strikethrough resistance when the two web plies are ring-rolled together. The strikethrough resistance of Example 8 is greater than either a single ply melt blown web as originally produced (Example 5) or two plies of melt blown webs that together add up to about the same basis weight (Example 6). Air porosity of the ring-rolled barrier ply of Example 8 was slightly less than that of the starting material having about the same basis weight, Examples 5 and 6.

While particular embodiments of the present invention have been illustrated and described, those skilled in the art will recognize that various changes and modifications can be made without departing from the spirit and scope of the invention. It is intended to cover, in the appended claims, all such modifications that are within the scope of this invention.

What is claimed is:

1. A process for making a nonwoven fabric barrier layer from at least two plies of hydrophobic microfine fiber webs, the fabric barrier layer having significantly increased liquid strike through resistance without any appreciable loss of air porosity in comparison to the original plies, comprising the steps of:

(a) simultaneously passing at least two abutting plies of hydrophobic microfine fiber webs through a sufficiently constrictive nip between two interdigitating grooved rolls to effect lateral stretching of said webs and light bonding of said webs together;

(b) passing said fabric barrier layer over a means for extending the fabric barrier layer to its fullest resultant width; and (c) collecting the fabric barrier layer.

2. A nonwoven fabric barrier layer made by the process of claim 1.

3. The process of claim 1 wherein there are two adjacent plies of hydrophobic thermoplastic microfine fiber webs.

4. A nonwoven fabric barrier layer made by the process of claim 3.

5. The process of claim 1 wherein said rolls have a surface temperature of from about 160° F. to 220° F. in order to reduce the tendency of tearing the webs.

6. A nonwoven fabric barrier layer made by the process of claim 5.

7. The process of claim 5 wherein there are two adjacent plies of hydrophobic thermoplastic microfine fiber webs.

8. A nonwoven fabric barrier layer made by the process of claim 7.

* * * * *

UNITED STATES PATENT AND TRADEMARK OFFICE

CERTIFICATE OF CORRECTION

PATENT NO. : 4,517,714

DATED : May, 21, 1985

INVENTOR(S) : Scott W. Sneed, Bill R. Schwam and Paul E. Gregory, Jr.

It is certified that error appears in the above-identified patent and that said Letters Patent is hereby corrected as shown below:

Column 6 at line 49: Table 2, the last line of the third column of the issued patent reads "(mm $H_2$)". The correct form is --(mm $H_2O$)--.

Signed and Sealed this

*Third* Day of *June 1986*

[SEAL]

*Attest:*

DONALD J. QUIGG

*Attesting Officer*

*Commissioner of Patents and Trademarks*